US007984959B2

(12) United States Patent
DeVore et al.

(10) Patent No.: US 7,984,959 B2
(45) Date of Patent: Jul. 26, 2011

(54) DETECTION OF MISSING NOZZLE FOR AN INKJET PRINTHEAD

(76) Inventors: David Wayne DeVore, Richmond, KY (US); Robert White Milgate, III, Lexington, KY (US)

( * ) Notice: Subject to any disclaimer, the term of this patent is extended or adjusted under 35 U.S.C. 154(b) by 95 days.

(21) Appl. No.: 12/346,946

(22) Filed: Dec. 31, 2008

(65) Prior Publication Data

US 2010/0165034 A1 Jul. 1, 2010

(51) Int. Cl.
*B41J 2/165* (2006.01)

(52) U.S. Cl. ..... 347/19; 347/23

(58) Field of Classification Search ..... 347/5, 9, 347/19, 22, 23, 35
See application file for complete search history.

(56) References Cited

U.S. PATENT DOCUMENTS 4,905,897 A * 3/1990 Rogers et al. ..... 239/1
5,617,124 A * 4/1997 Taylor et al. ..... 347/35
6,540,316 B1 * 4/2003 Imanaka et al. ..... 347/14
7,159,964 B2 * 1/2007 Funk et al. ..... 347/36
7,250,087 B1 * 7/2007 Tyson et al. ..... 134/18
7,540,597 B2 * 6/2009 Guhse et al. ..... 347/84

FOREIGN PATENT DOCUMENTS

JP 2-086865 * 3/1990

* cited by examiner

*Primary Examiner* — Huan H Tran

(57) ABSTRACT

A technique for detecting a defective printhead nozzle employing acoustical energy. During printhead maintenance, the nozzles of the printhead are sequentially fired to eject ink therefrom. The acoustical energy emitted by a nozzle during ejection of an ink droplet can be detected by a sound receiver. Acoustical energy can also be transmitted in the field of travel of the ink droplet so that when the ink droplet passes therethrough the acoustical energy is perturbated, and such perturbation can be detected. The perturbation can be an attenuation of the received acoustical energy when the ink droplet passes between the acoustical transmitter and a sound receiver. The perturbation can also be a change in the acoustical energy when the ink droplet reflects acoustical energy from the acoustical transmitter to the sound receiver.

19 Claims, 2 Drawing Sheets

DETECTION OF MISSING NOZZLE FOR AN INKJET PRINTHEAD

BACKGROUND

1. Field of the Invention

The present invention relates generally to an inkjet printer system and, more particularly to apparatus and methods for detecting a missing nozzle in the printhead of an inkjet printer.

2. Description of the Related Art

Inkjet printers employ a printhead having a plurality of nozzles for ejecting a microdroplet of ink onto a print media, such as paper. In many printers the printhead is moved laterally back and forth in a swath and the paper is scrolled, so that the desired text or image is printed on the print media. Other printing techniques can utilize a stationary printhead and a carriage mechanism that moves the paper both laterally and vertically. The printhead is constructed using a semiconductor structure with numerous holes or nozzles formed therein, which are connected to an ink delivery channel. Many printers have a number of arrays of nozzles, one array for printing cyan, one for yellow, one for magenta and one for black. Some printers also include a redundant array of nozzles. A heater formed in the semiconductor structure can be energized to heat the ink adjacent the nozzle to nucleate the ink into a droplet that is ejected forwardly from the nozzle opening. Generally, nozzle diameters range from about 5 to 20 microns. In view of the very small nozzle opening, a single microdroplet of ink can be difficult to see with the naked eye. Because of the very small size of the printhead nozzles, they can be clogged or otherwise prevented from operating properly. Ink or air can clog the nozzles, the ink heater for a nozzle can become defective, and many other printhead malfunctions can occur to prevent the proper ejection of ink from a nozzle.

During the normal operation of an inkjet printer, the controller is programmed to periodically perform a maintenance routine to simultaneous activate all nozzles numerous times to eject ink therefrom. The printhead maintenance routine is often carried out by moving the printhead to an extreme left or right carriage position where the nozzles are directed to a "spit cup" or container. The spit cup contains the dispensed ink therein. When in the maintenance position, the controller proceeds through the routine in which all nozzles are addressed plural times to simultaneously eject ink in an attempt to clean the same and provide reliable operation. This procedure can be carried out prior to the printing of a print job, after the printer has been inactive for a certain period of time, or for other reasons.

With some inkjet printers, defective nozzles can be detected by printing a sample after the printhead maintenance has been completed. An array of detector diodes is provided to sense the dot pattern on the printed sample. If the test shows that all of the dots are present, then it is assumed that all of the nozzles are operating properly. The disadvantage of this printhead test is that paper is used and additional time is required.

If it is determined that one or more nozzles are inoperative, then other corrective measures can be employed. For example, the controller can automatically carry out programmed routines to use neighbor nozzles and move the paper or printhead accordingly in order to compensate for the inoperative nozzle, all without significantly compromising the quality of the print job. If a number of nozzles are inoperative, then the time to print the job may increase due to the use of the extra compensating measures.

In view of the foregoing, it can be seen that a need exists for a technique to quickly test the printhead to determine if any nozzle is defective, and the particular nozzle that is defective. During the printhead cleaning operation, it would be advantageous to also determine whether any of the nozzles are defective or "missing," without printing a sample.

SUMMARY OF THE INVENTION

The present invention meets these and other needs by firing the printhead nozzles sequentially during maintenance to clean the nozzles, and at the same time receive corresponding acoustical energy to determine if all of the nozzles are operating properly. According to one feature, the acoustical energy produced by a nozzle ejecting ink is detected. The perturbation in the steady state acoustical energy caused by the firing of the inkjet indicates the presence of an ink droplet, and the proper operation of the corresponding nozzle.

Mounted to the spit cup of the printer is a microphone or sound receiver to detect the acoustical energy produced by each nozzle. As the nozzles are sequentially fired to eject ink and clear any dried ink, the acoustical energy of each nozzle is simultaneously gathered and stored in digital form for processing. The sequential firing of each nozzle occurs at predefined intervals, or time slots. The acoustical energy is received during the respective time slot, whereby the samples of acoustical energy can be associated with the proper nozzles. The acoustical energy received by the sound receiver during each time slot can be processed to determine whether a fired nozzle ejected ink during its respective time slot.

The acoustical energy used to determine if a nozzle ejected an ink droplet can also be the ambient acoustical energy present during printer operation. The ambient acoustical energy received by the sound receiver in this case remains at a steady state level, except when a droplet of ink passes in front of the sound receiver. In this event, the droplet blocks the acoustical energy reaching the sound receiver and the attenuated signal received is an indication of the presence of a droplet of ink, and the proper operation of the nozzle. A directional microphone can be used as the sound receiver.

The acoustical energy employed for determining the proper operation of the nozzles can be generated by an acoustical sound generator. As the droplet of ink passes in the proximity of the sound receiver, the acoustical signal received is attenuated, thus providing an indication of the presence of the ink droplet. In this embodiment, the characteristics of the acoustical signal generated by the generator are known, and thus the determination of the presence of the ink droplet during processing of the signals is made easier.

According to another embodiment, the presence of an ink droplet can be detected by receiving reflected acoustical signals. The reflected acoustical signals are those reflected from the ink droplet and redirected to the sound receiver. Depending on the placement of the acoustical generator with respect to the sound receiver, the acoustical energy received by the sound receiver can be either accentuated or attenuated. This depends on other reflections and phasing of the acoustical energy reflected from other surfaces of the spit cup or the printhead itself, before being received by the sound receiver.

BRIEF DESCRIPTION OF THE DRAWINGS

Figure 1:
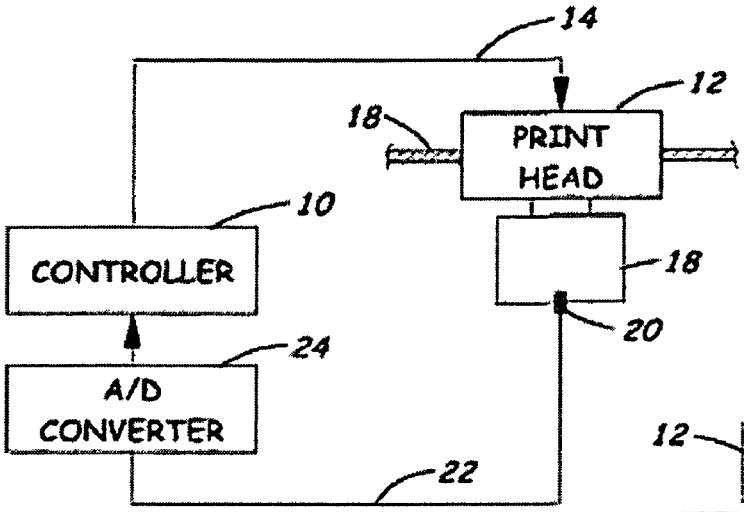

Having thus described the invention in general terms, reference will now be made to the accompanying drawings, which are not necessarily drawn to scale, and wherein:

FIG. 1 is a block diagram of a printer controller and related circuits of an inkjet printer.

Figure 2:
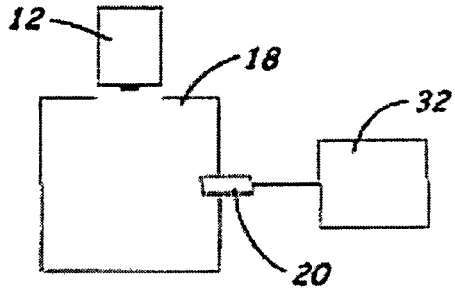

FIG. 2 is a simplified diagram of a technique for the passive reception of sound from an activated inkjet nozzle to ascertain the functionality thereof.

Figure 3:
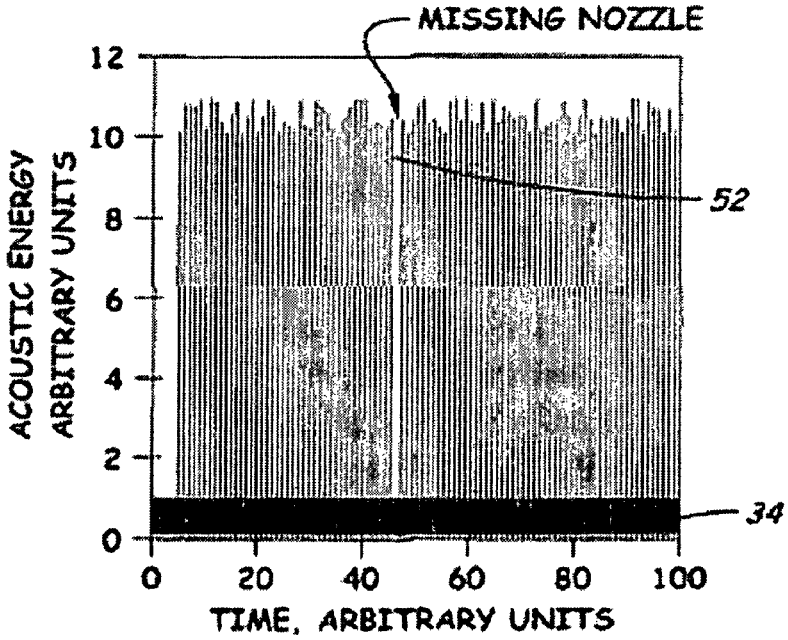

FIG. 3 is a diagram that graphically illustrates the sound pattern of a plurality of nozzles using the apparatus of FIG. 2, with one nozzle failing to operate.

Figure 4:
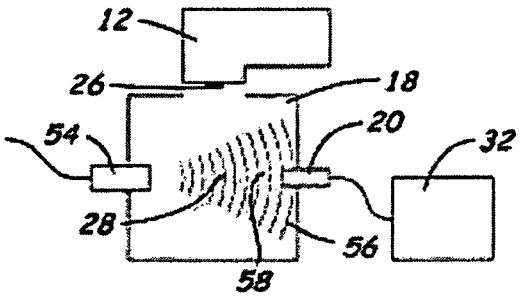

FIG. 4 is a simplified diagram of a technique that uses an acoustical generator for generating acoustical energy in the spit cup, and the passing of an ink droplet in the proximity of the sound receiver results in the attenuation of the acoustical signal received.

Figure 5:
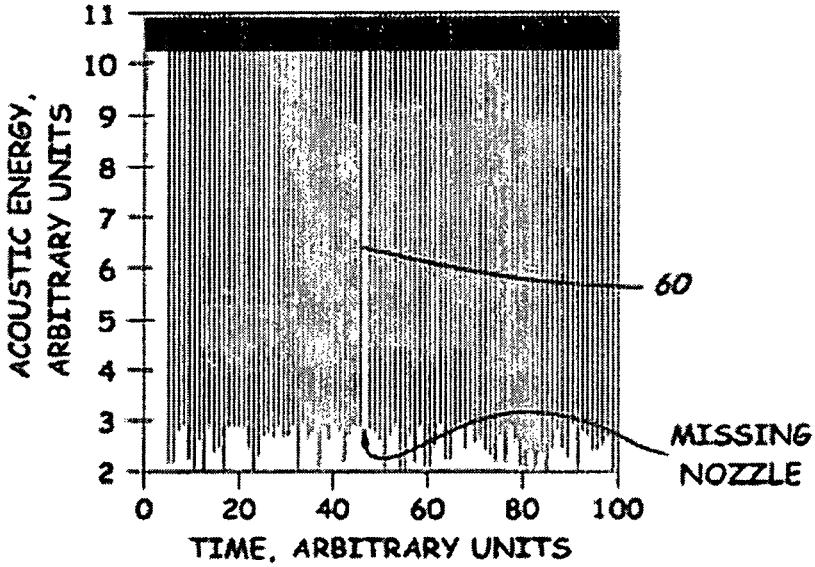

FIG. 5 is a diagram that graphically illustrates the sound pattern of a plurality of nozzles using the apparatus of FIG. 4, with one nozzle failing to operate.

Figure 6:
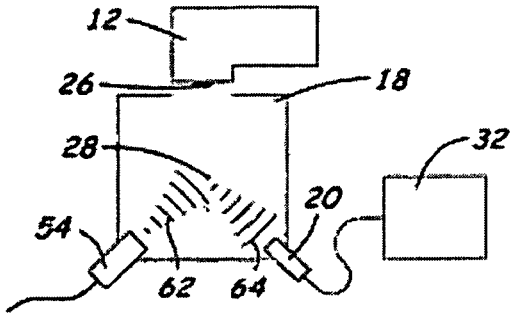

FIG. 6 is a simplified diagram of a technique that uses a generator for transmitting acoustical energy in the spit cup, and the presence of an ink droplet causes a reflection of the acoustical energy from the generator to the sound receiver, thus identifying an operable nozzle.

Figure 7:
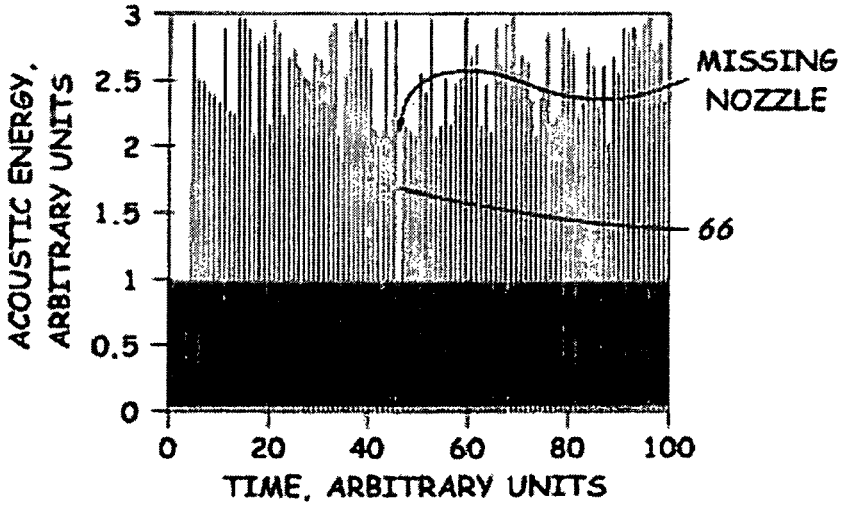

FIG. 7 is a diagram that graphically illustrates the sound pattern of a plurality of nozzles using the apparatus of FIG. 6, with one nozzle failing to operate.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated a block diagram of apparatus for operating an inkjet printer. A programmed controller 10 electrically drives an inkjet printhead 12 via a ribbon cable 14 to cause specified nozzles to fire and produce a character on a print medium (not shown). The printhead 12 is moved laterally in a swath by a carriage mechanism 16. Signals carried on the cable 14 are used to address the various nozzles (not shown) in the printhead 12 to activate the same and fire droplets of ink. Generally, the ink is jetted toward a print medium, such as paper. However, during the cleaning of the printhead 12, the carriage 16 moves the printhead 12 to an extreme side position, directly in front of a spit cup 18. This position is typically beyond the edge of any paper sheet in the carriage mechanism. According to some embodiments disclosed herein, the controller 10 sequentially drives each nozzle of the printhead 12 to perform maintenance thereon, as well as detect any defective nozzle during the same maintenance procedure.

As described below, sound is employed to determine if the printhead has a defective nozzle. It can be appreciated that since a nozzle has only two states, operable and inoperable, if one state is determined, then the other state is also known. The sound that is affected by a droplet of ink is detected by a microphone 20 mounted to the spit cup 18. The microphone 20 converts the sound waves into corresponding electrical signals that are carried on electrical line 22 to an A/D converter 24. The A/D converter 24 can be a circuit separate from the controller 10, or incorporated within the controller 10. It should be noted that while the described embodiment employs circuits for converting the electrical signals of the acoustical energy to digital form for processing, those skilled in the art may choose to process the analog signals using analog circuits.

The controller 10 is programmed with one or more algorithms for processing the electrical signals generated by the microphone 20 to determine whether each of the printhead nozzles is operating. The signals can be filtered to remove extraneous noise and other signals that are outside the spectrum of the signals necessary in determining the operation and non-operation of the nozzles. In order to improve the predictability in determining the operational status of each print head nozzle, the controller 10 sequentially addresses each nozzle in the printhead 12 and receives the corresponding series of sound-related signals. The nozzles can be sequentially activated at a rate such as 9 KHz. The data representative of the received sound signals for each nozzle is stored in a memory of the controller 10. Then, the sequence is repeated and each nozzle is sequentially addressed and activated, whereupon a second set of sound-related signals are received and processed. After a number of sets of data is accumulated by the controller 10 for each nozzle of the printhead 12, the data for each nozzle may be further processed to maximize the parameter which is used to determine if a nozzle is defective, or not. This further processing can be the summation or an overlay of the signals of a nozzle for the sets of repetitions. This is carried out for each nozzle. Other optimizing algorithms can be used to focus on the particular sound energy, frequency or other characteristic that assures one that with the presence of such parameter, the nozzle is operational, and when the particular parameter is absent, or reduced n magnitude, the nozzle is inoperative. It is understood that the sound received by the microphone 20 includes many other sounds unrelated to the operation of the nozzle, including mechanical noises, motor noises, fan noises, room noises, etc. Thus, the processing of the sound-related signals by the controller 10 is directed to algorithms and techniques to minimize the effects of the sounds unrelated to the nozzle operation, and maximize the sound signals that are known to be directly related to the nozzle operation.

With reference to FIG. 2, there is illustrated one embodiment of a printhead 12 adapted for using acoustical waves to determine the operability of the nozzles thereof. The many nozzles of the print head 12, one shown as numeral 26, are located just in front of an opening in the spit cup 18. When the controller 10 signals the particular nozzle 26 to fire a microdroplet 28 of ink, the nozzle 26 emits a corresponding acoustical sound wave 30. While the magnitude of the sound 30 emitted by an inkjet nozzle 26 is small, it nevertheless exists with a sufficient acoustical energy as to be detected by a microphone 20 or other sound receiver. The microphone 20 need not be of any special type, but of sufficient quality to detect small-magnitude sound waves. The microphone 20 is mounted to the spit cup 18 at a location so as not to be in the path of the ejected ink droplet 28.

The acoustical energy collected by the microphone 20 is passed through appropriate signal conditioning circuits 32 so as to increase the signal to noise ratio thereof and maximize the sound parameter created as each nozzle is ejecting a droplet of ink. The signal conditioning circuit 32 can include filters, amplifiers and other circuits for removing components of printer background sounds that are not related to the ejection of ink droplet from a nozzle. Special signal analysis can be carried out to distinguish the sound produced by the firing of a nozzle from the background noise. For example, a Fourier analysis can be carried out by sequentially firing the nozzles a first time at a first rate, and then sequentially firing all the nozzles a second time at a different rate, and so on. The data received from the firing of each nozzle can be subjected to a Fourier transform analysis to more accurately identify the difference between the acoustical energy during the presence and absence of an ink droplet. It can be appreciated that different types and styles of printheads will have different nozzle sounds, and thus the signal conditioning will be different. In any event, the conditioned electrical signals are converted to corresponding digital signals by the A/D converter 24 to be further processed by the algorithms of the controller 10. As noted above, each nozzle of the printhead 12 is activated in a sequence, and the results are collected and stored in the memory of the controller 10. Those skilled in the art may find it expedient to first convert the acoustical waves from the microphone 20 to digital signals and then carry out the signal conditioning on the digital signals.

FIG. 3 illustrates the processed digital data in graphical form. The vertical axis represents the acoustical energy in arbitrary units. The horizontal axis represents time, also in arbitrary units. It should be noted that the controller 10 starts the sequential firing of each nozzle 26 of the printhead 10, starting at time To for about 0.11 ms (9 KHz) for the first time slot. The next nozzle is fired in the next time slot, and so on until all nozzles have been sequentially fired. The duration of each time slot for each nozzle is thus 0.11 ms, and there are at least as many time slots as there are nozzles 26. Thus, it is known during the printhead maintenance test which time slot is uniquely associated with which nozzle 26.

For purposes of example, it can be seen in FIG. 3 that there are 100 time slots for a corresponding 100 nozzles 26. After the processing of the acoustical signals for each nozzle 26 and the accumulation of respective data, the controller 10 can determine if a nozzle is defective (missing). The controller 10 can, for example, establish a threshold of the acoustical energy, above which it is considered that the nozzle is operable, and below which it is determined that the nozzle 26 is defective. It is seen in FIG. 3 that the low levels of the acoustical energy 34 represents noise and should be disregarded. If an arbitrary threshold is established as acoustical energy level 8, then the controller 10 sequentially accesses the data for each nozzle 26 and determines all those that have corresponding acoustical levels above the arbitrary threshold of 8. It is noted in the example of FIG. 3 that 99 nozzles have thresholds above level 8, and one nozzle occupying time slot 52 fails to have an acoustical level above the threshold, and thus is considered as being defective. The controller 10 can consult a table to find the association of the time slot to the particular nozzle and flag the same so that compensating measures can be implemented to overcome the adverse printing effects presented by the defective nozzle. One of the compensating measures can be the burst firing of only the defective nozzle in an attempt to clean or otherwise unplug it.

Thus, it can be seen from the embodiment of FIG. 2 that the detection of the background noise during the time slot of interest represents the absence of an ink droplet ejected from the nozzle 26. On the other hand, the detection of a perturbation in the background noise represents the presence of an ink droplet ejected from the nozzle 26. In this instance, a perturbation of the background noise is the acoustical sound made by the nozzle 26 as it ejects a droplet of ink.

With reference to FIG. 4 of the drawings, there is illustrated another embodiment of the invention. Here, the sound that is analyzed is not the acoustical energy made by the individual nozzles during ejection of the ink droplets. Rather, a sound transducer 54 is mounted to the spit cup 18, in a sidewall thereof generally opposite the location of the microphone 20. The transducer 54 is of a conventional type that converts electrical signals to sound, like a miniature speaker. In order to improve the reliability of the droplet detection technique, the frequency of the sound transducer 54 has a wavelength that is less than the diameter of the ink droplet 28. The transducer 54 can be of a piezoelectric or other type of transducer. The controller 10 drives the transducer 54 with electrical signals so that a particular sound is produced. A single frequency sinusoidal signal is preferred in driving the transducer 54, as it is easier to process the corresponding signals. Also, since the particular characteristics of the sound that is produced by the transducer 54 is known, it is easier to condition and process the same so that extraneous frequencies can be suppressed, thereby increasing the signal to noise ratio. The sound produced by the transducer 54 can be continuous, but it need not be as it can be pulsed in coincidence with the activation of the nozzles 26.

In operation, the sound waves 56 are emitted from the transducer 54 into the cavity of the spit cup 18. The sound waves 56 are directed toward the microphone 20. As a microdroplet of ink 28 passed through the sound waves 56, there is an attenuation in the magnitude of the sound waves in the cone 58. The attenuation of the acoustical sound waves comprises a perturbation of the steady state sound waves received by the microphone 20. As can be appreciated, the attenuation cone 58 moves with the droplet 28 of ink in the spit cup 18. This attenuation in the magnitude of the sound waves 56 can be detected by the microphone 20 during the time slot in which the nozzle 26 is fired. Again, the signals received in connection with each time slot are conditioned, converted to corresponding digital signals and processed by the controller 10.

FIG. 5 is a chart that illustrates the acoustical energy as a function of the time slots, it being understood that each time slot is representative of the time period in which a single nozzle is activated by the controller 10. Here, there is a steady state level of sound waves 56 received by the microphone 20, except when an ink droplet travels therethrough, in which event the cone 58 of attenuation is present. The cone of attenuation 58 presents a reduced level of sound that reaches the microphone 20 when the ink droplet 28 passes between the sound-producing transducer 54 and the microphone 20. In this case, the signal conditioning and processing is aimed at finding a minimum amount of acoustical energy during the time slot for each nozzle activation. The perturbation in the steady state level of acoustical sounds comprises the attenuation of the sound waves in the cone 58. The detection of the perturbation indicates that particular nozzle 26 is operating properly. In the chart of FIG. 5, it can be seen that during time slot 48, the level of the acoustical energy is not reduced (shown by numeral 60), indicating the absence of an ink droplet 28 being ejected from the respective nozzle number 48. The determination of a nozzle 26 that is inoperative causes a flag to be placed in association with such nozzle in the memory of the controller 10. Corrective action can be carried out in the manner described above.

While the embodiment illustrated in FIG. 4 relies on the use of an acoustical transducer 54, the acoustical energy can be generated in other ways. For example, the continuous background noise in the printer environment can be employed as a sound generator. The background printer noise can be that generated by printer motors, fans, etc. This background noise can serve as an acoustical energy generator. The sound receiver 20 can sense the cone of sound attenuation of the printer noise in the presence of an ink droplet, in the same manner described above in connection with FIG. 4. To that end, the detection of the presence and absence of an ink droplet is much like that illustrated above in connection with FIG. 2.

FIG. 6 illustrates another embodiment for detecting a defective printhead nozzle using acoustical energy. In this embodiment, the sound-producing transducer 54 is placed at a location in the spit cup 18 so that the sound received by the microphone 20 comprises reflections from the droplet of ink. In the example, the sound-producing transducer 54 is located at one corner of the spit cup 18 and the microphone 20 is located at an adjacent corner of the spit cup 18. As can be seen, the sound waves 62 emitted from the transducer 54 are not directed directly toward the microphone 20, but rather are directed in a path orthogonal to an axis of the microphone 20. Accordingly, as the ink droplet 28 passes through the sound waves 62 emitted from the transducer 54, the droplet 28 reflects some of the acoustical energy which is received by the microphone 20. It is appreciated that the sound waves emitted from the sound-producing transducer 54 are also reflected from the sidewalls, top and bottom of the spit cup 18, as well as reflected from the printhead 12 itself. Thus, the microphone 20 receives reflected acoustical energy from many surfaces, as well as noise generated external to the spit cup 18. However, despite all of the reflections and noise received by the microphone 20 in the absence of an ink droplet 28, which represents a composite steady state signal, the droplet of ink 28 passing through the spit cup 18 causes a perturbation in the magnitude of the acoustical energy received by the microphone 20. It is this change in the acoustical energy received by the microphone 20 that signals the presence of a droplet 28 of ink in the spit cut 18, and thus the operability of the corresponding nozzle 26. Indeed, the perturbation in the steady state signal received by the microphone 20 in the presence of an ink droplet 26 can be either a larger acoustical signal magnitude, or a smaller acoustical signal magnitude. Whether the acoustical signal received by the microphone 20 is larger or smaller during the passage of the ink droplet 28 in the spit cup 18 depends on many factors, including the location of the transducer 54 relative to the microphone 20, the shape of the spit cup 18, the phasing between primary and reflected sound waves, the number of reflections of the acoustical signals before reaching the microphone 20, etc.

The processed acoustical signals resulting from the technique of FIG. 6 are shown in FIG. 7. This assumes that the absence of an ink droplet 28 passing in the spit cup 18 results in a reduced magnitude of acoustical energy received by the microphone 20. For each time slot when the respective nozzle 26 is operating properly, there is a steady state level of acoustical energy 66, as compared to the steady state acoustical level when no ink droplet 28 passes into the spit cup 18. This steady state level of acoustical energy is shown for all time slots in FIG. 7, except for time slot 48 where the acoustical energy is reduced. The presence of the droplet 28 of ink as it passes through the spit cup 18 causes the acoustical energy received by the microphone to be reduced. This perturbation in the steady state acoustical signal is an indication that nozzle number 48 is operating properly. In the absence of a perturbation in the steady state acoustical signal during time slot 48, a conclusion can be reached that nozzle 48 is defective, whereupon the controller 10 can proceed to carry out measures to compensate for the same.

In summary, disclosed are techniques for detecting a defective nozzle in the printhead of an inkjet printer. As discussed, the detection of an inoperative nozzle can be carried out at the same time as printhead maintenance, except the nozzles are sequentially fired instead of firing all of the nozzles at the same time. During printhead maintenance, the steady state acoustical energy is received and processed. Perturbations detected in the steady state acoustical energy may indicate either the presence or absence of an ink droplet ejected from a nozzle.

The acoustical energy emitted from a nozzle firing a droplet of ink can be detected by a sound receiver. If a nozzle of the printhead is activated to eject a droplet of ink, and no corresponding jetting sound is received, then it can be concluded that the nozzle is defective. Acoustical energy can also be transmitted in the area of travel of the ink droplet, and the perturbations caused by the presence of the ink droplet in the acoustical energy can be detected by a sound receiver. The perturbations in the acoustical energy can be the attenuation in the acoustical energy when the ink droplet passes between the acoustical energy transmitter and the sound receiver. The perturbations can also be the change in the acoustical energy received by the sound receiver when the ink droplet causes the acoustical energy to be reflected. In any of the techniques, the acoustical energy received by the sound receiver is processed to optimize those sound signal components that indicate the presence and/or absence of the ink droplet. When it is determined that a printhead has one or more missing or defective nozzles, corrective measures can be undertaken to compensate for the same and optimize the print quality.

In many embodiments of the invention, the sound received for each time slot is processed and analyzed to determine whether the nozzle has ejected an ink droplet, or not. The determination as to whether a nozzle is functioning properly can also be carried out by processing the sound received from all of the time slots to note a consistency in the repetition of the time slot sounds. In other words, it may be found that there is a rhythm in the repetition or cadence in the sounds received during each time slot. A missing beat or different cadence sensed in the set of sounds can indicate one or more defective nozzles.

It may be advantageous to identify the acoustical signature of ink droplets according to the various embodiments disclosed herein. In other words, there may be a specific spectrum of frequencies and amplitudes which specifically characterize whether an ink droplet was ejected from a nozzle. Frequencies that lie outside the spectrum of the signature can be filtered or otherwise disregarded to improve the identification of missing nozzle events. Thus, by knowing the acoustical signature of energy during the test process, one can better segregate the signature from the background noise and make a better determination of any missing nozzles.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A method for detecting a defective nozzle in a printhead, comprising:

sensing with a common sound receiver acoustical energy proximate a plurality of nozzles of the printhead;

converting the acoustical energy to corresponding electrical signals;

processing the electrical signals to determine one or more defective nozzles of the plurality of nozzles of the printhead; and receiving a perturbation in the acoustical energy caused by a jetting of the ink droplet from the printhead.

2. The method of claim 1, further including receiving background noise as acoustical energy in the absence of an ink droplet ejected from the printhead.

3. The method of claim 1, further including locating the common sound receiver in a spit cup of a printer employing the printhead.

4. The method of claim 1 further including carrying out printhead maintenance by sequentially firing jets of the print head to eject ink therefrom, and receiving the acoustical energy during the firing of each such jet, and analyzing the received acoustical energy to determine the presence or absence of an ink droplet.

5. The method of claim 4 further including identifying a defective printhead nozzle during said maintenance, and thereafter repeatedly firing the defective nozzle without firing operational nozzles.

6. The method of claim 5, further including receiving acoustical energy associated with the defective nozzle to determine if the repeated firing thereof renders the nozzle operable.

7. A method for detecting a defective nozzle in a printhead, comprising:

sensing with a common sound receiver acoustical energy proximate a plurality of nozzles of the printhead;

converting the acoustical energy to corresponding electrical signals; and processing the electrical signals to determine one or more defective nozzles of the plurality of nozzles of the printhead, further including transmitting acoustical energy having known characteristics from a transmitter, and receiving acoustical energy perturbated by the presence of an ink droplet therein.

8. The method of claim 7 further including processing digital signals corresponding to the perturbated acoustical signals to identify the perturbation and determine a presence or absence of the ink droplet.

9. The method of claim 7 further including determining that an ink droplet is present when the received acoustical signal is reduced in magnitude as compared to acoustical signals received when an ink droplet is absent.

10. The method of claim 7 further including determining that an ink droplet is present when the received acoustical signal is increased in magnitude as compared to acoustical signals received when an ink droplet is absent.

11. The method of claim 9 further including determining that an ink droplet is present when the ink droplet passes between an acoustical energy transmitter and the common sound receiver, whereby the common sound receiver is in a cone of reduced acoustical energy.

12. The method of claim 10 further including determining that an ink droplet is present when the ink droplet passes through an area in which acoustical energy is reflected from the ink droplet to the common sound receiver.

13. A method for detecting a defective nozzle in a printhead, comprising:

sensing with a common sound receiver acoustical energy proximate a plurality of nozzles of the printhead;

converting the acoustical energy to corresponding electrical signals;

processing the electrical signals to determine one or more defective nozzles of the plurality of nozzles of the printhead, further including using an acoustical transmitter that transmits a frequency having a wavelength that is less than a diameter of the ink droplet.

14. A method for detecting a defective nozzle in a printhead, comprising:

performing maintenance on the print head by sequentially firing the nozzles of the printhead;

during each said nozzle firing, receiving acoustical energy associated with the presence or absence of a respective ink droplet;

determining whether each of the nozzles are operable or defective based at least in part on the received acoustical energy; and firing the defective nozzle repeatedly if the nozzle is determined to be operating improperly.

15. The method of claim 14, further including receiving acoustical energy produced by the nozzle during firing thereof.

16. The method of claim 14, further using an acoustical generator to generate acoustical energy, and receiving acoustical energy which is attenuated when an ink droplet passes between the acoustical generator and a sound receiver.

17. The method of claim 14 further including using an acoustical generator to generate acoustical energy, and receiving acoustical energy which is reflected when an ink droplet ejected from a nozzle.

18. A printer having a printhead for ejecting ink from a plurality of nozzles, comprising;

a spit cup for receiving said ink from the nozzles during a printhead maintenance routine;

a common sound receiver mounted to the spit cup to jointly monitor each of the nozzles during the printhead maintenance routine; and a printer controller configured to carry out the printhead maintenance routine where said each nozzle is sequentially fired to eject ink;

said controller configured to receive from the common sound receiver a signal representative of an acoustical signal occurring during the sequential firing of said each nozzle; and said controller further configured to process the representative signals to determine whether said each nozzle is ejecting said ink.

19. The printer of claim 18 wherein the common sound receiver is a microphone.

* * * * *